US006159064A

United States Patent [19]

Takeuchi et al.

[11] Patent Number: 6,159,064

[45] Date of Patent: Dec. 12, 2000

[54] SWIMMING FIN

[75] Inventors: Minoru Takeuchi; Yoshiharu Takizawa; Haruo Kawashima; Shoji Fujiwara, all of Tokyo, Japan

[73] Assignee: Tabata Co. Ltd., Japan

[21] Appl. No.: 09/264,559

[22] Filed: Mar. 8, 1999

[30] Foreign Application Priority Data

Mar. 9, 1998 [JP] Japan ..... 10-056544

[51] Int. Cl.[7] ..... A63B 31/08

[52] U.S. Cl. ..... 441/64; 441/61

[58] Field of Search ..... 441/60, 61, 62, 441/63, 64

[56] References Cited

U.S. PATENT DOCUMENTS

| | | | |
|---|---|---|---|
| D. 151,229 | 10/1948 | Eddy | D21/806 |
| 3,019,458 | 2/1962 | Barbieri et al. | 441/64 |
| 3,055,025 | 9/1962 | Ferraro et al. | 441/64 |
| 4,627,820 | 12/1986 | Penebre | 441/64 |
| 4,954,112 | 9/1990 | Nagrini et al. | 441/64 |
| 5,290,194 | 3/1994 | Sneddon et al. | 441/64 |
| 5,358,439 | 10/1994 | Paolo | 441/64 |
| 5,522,748 | 6/1996 | Cressi | 441/64 |
| 5,683,279 | 11/1997 | Raasch et al. | 441/64 |
| 5,975,973 | 11/1999 | Fleming | 441/64 |

FOREIGN PATENT DOCUMENTS

| | | | |
|---|---|---|---|
| 2543841 | 10/1984 | France | 441/64 |
| 2611509 | 9/1988 | France | 441/64 |
| 5-63563 U | 8/1993 | Japan . | |
| 272114 | 9/1988 | U.S.S.R. | 441/64 |

*Primary Examiner*—S. Joseph Morano
*Assistant Examiner*—Ajay Vasudeva
*Attorney, Agent, or Firm*—Baker & Daniels

[57] ABSTRACT

A swimming fin includes a blade and a foot pocket, the blade including a relatively long first blade and a short second blade. The second blade underlies a bottom surface of the first blade and has transversely opposite side edge regions longitudinally extending inside transversely opposite side edges of the first blade and an intermediate region extending between the side edge regions and having its front end curved toward the foot pocket. The swimming fin thus formed can strengthen a thrust obtained by down-kicking movement of the swimming fin to thereby facilitate the up-kicking movement of the swimming fin.

8 Claims, 5 Drawing Sheets

SWIMMING FIN

BACKGROUND OF THE INVENTION

This invention relates to a swimming fin or flipper used during swimming.

Japanese Utility Model Application Disclosure Gazette (Kokai) No. Hei5-63563 discloses a swimming fin formed on a top surface of a blade with a plurality of grooves to obtain a high thrust during down-kicking movement of the swimming fin. Such a blade is transversely curved with the top surface thereof inside during the down-kicking movement so that an amount of water caught inside the blade may be moved backward of a swimmer and thereby a high thrust may be obtained. The presence of the grooves is claimed to facilitate the blade to be curved.

With this known swimming fin, the grooves formed on the top surface of the blade form the corresponding ribs on a bottom surface of the blade. These ribs make it difficult to deform the swimming fin smoothly during up-kicking movement of the swimming fin and to alleviate a water resistance. Consequently, if the swimmer intends to obtain a high thrust by the down-kicking movement of the swimming fin, a physical burden imposed on the swimmer is increased and inevitably the up-kicking movement of the swimming fin becomes slow.

SUMMARY OF THE INVENTION

In view of the problem as has been described above, it is an object of the invention to provide a swimming fin improved so that a thrust obtained by the down-kicking movement of the swimming fin can be strengthened and the up-kicking movement can be facilitated.

According to the invention, there is provided a swimming fin comprising: a foot pocket; a blade extending forward from a front end of the foot pocket; the blade including a first blade and a second blade shorter than the first blade and underlying the first blade; the second blade including transversely opposite side edge regions which extend from a front end of the foot pocket forward inside transversely opposite side edges of the first blade and terminate short of a front end of the first blade, and an intermediate region which extends between the side edge regions and having a front end thereof substantially curved toward the foot pocket.

According to an embodiment of the invention, the foot pocket and the first blade are integral moldings and the second blade is detachably assembled with the moldings.

According to another embodiment of the invention, the second blade is provided along the side edge regions with arms extending rearward so that these arms may be removably inserted into longitudinal locking holds formed on transversely opposite outer sides of the foot pocket and thereby held in these locking holds.

According to still another embodiment of the invention, the second blade, the foot pocket and/or the first blade are integral moldings.

The swimming fin according to the invention allows a relatively large amount of water to be caught to generate a high thrust because of the unique construction such that the relatively short second blade is provided on the bottom side of the relatively long first blade and the undesirable deformation of the first blade is effectively restricted by the second blade during down-kicking movement of the swimming fin so that the first blade is not substantially deformed at its rear region. The portion of the first blade extending forward from the front end of the second blade can be transversely curved so as to prevent an amount of water caught by the bottom surface of the blade from escaping aside and thereby to strengthen a thrust. During up-kicking movement of the swimming fin, the first blade can be deformed over its full length without being restricted by the second blade and therefore no significant resistance is generated, thus enabling speedy up-kicking movement of the swimming fin.

DESCRIPTION OF THE PREFERRED EMBODIMENTS

Details of a swimming fin according to the invention will be more fully understood from the description given hereunder with respect to the accompanying drawings.

Figure 1:
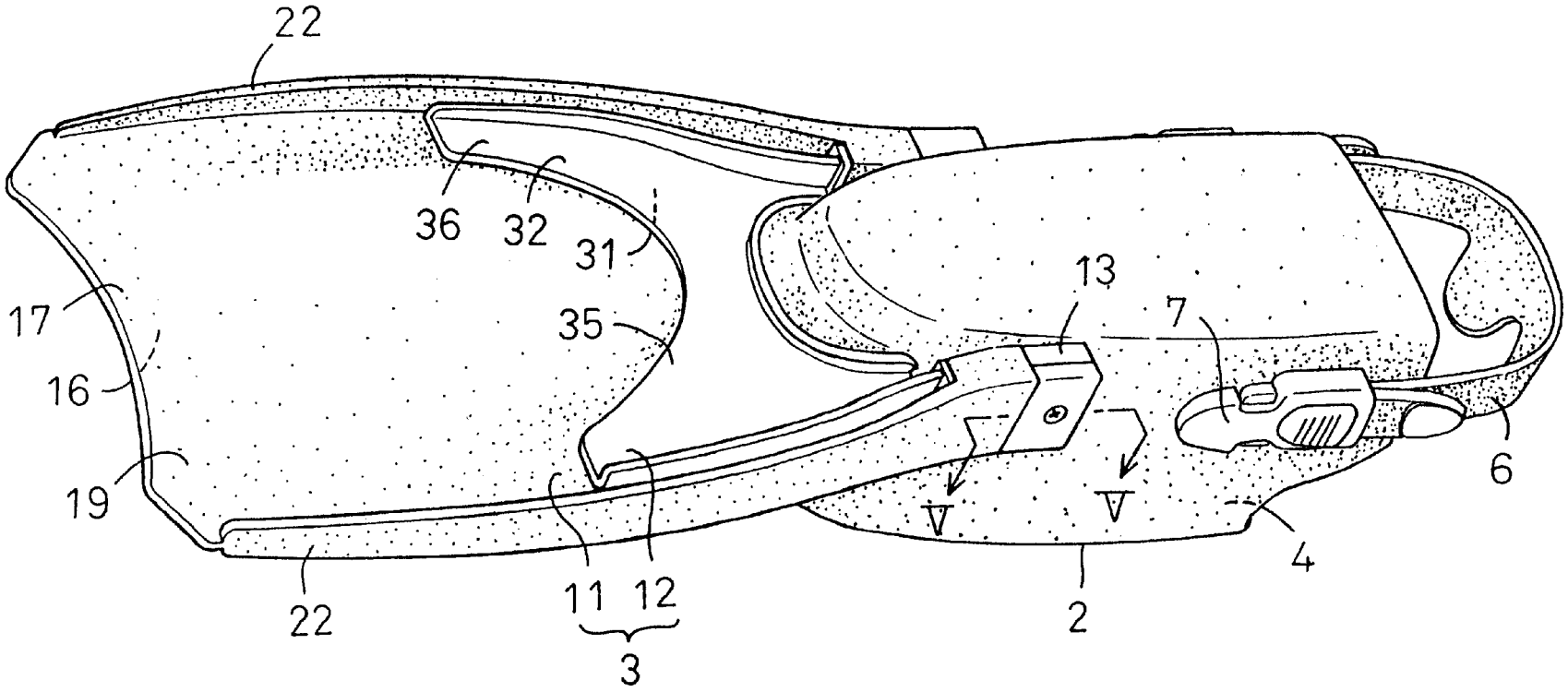
FIG. 1 is a perspective view of a swimming fin constructed according to one embodiment of the invention.

FIG. 1 is a perspective view showing a swimming fin with its bottom side (i.e., foot sole) facing upward. This swimming fin has a foot pocket 2 and a blade 3. A rear end of the foot pocket 2 is defined by a foot insertion opening 4 and a heel strap 6 extends between laterally opposite outer sides of the foot insertion opening 4. The heel strap 6 has its longitudinally opposite ends attached to the outer sides of the foot insertion opening 4 by means of respective buckles 7 in a detachable and length-adjustable manner. The blade 3 comprises a relatively long first blade 11 and a relatively short second blade 12 underlying the first blade 11 (with respect to the foot sole). The first blade 11 is molded integrally with the foot pocket 2 and extends forward from a front end of the foot pocket 2. The second blade 12 is detachably connected by means of stopper members 13 to the first blade 11 and extends forward from the front end of the foot pocket 2.

Figure 2:
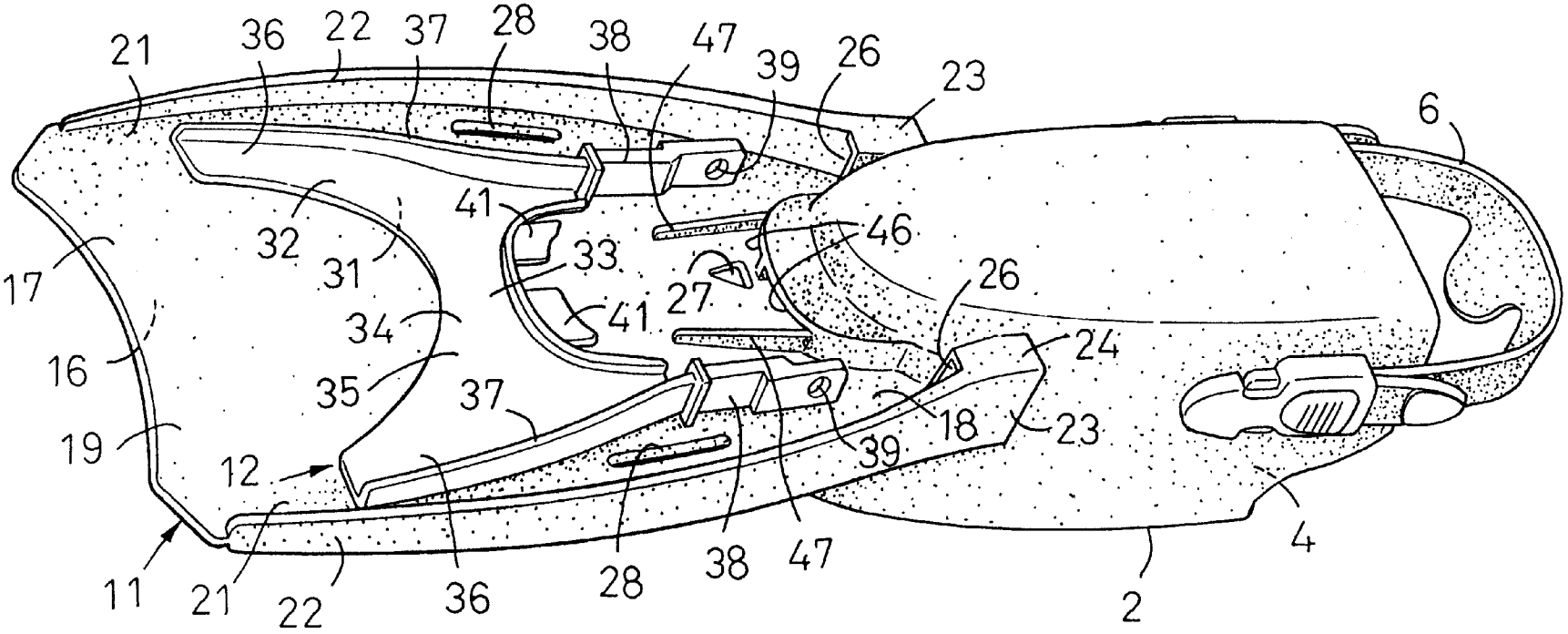
FIG. 2 is an exploded perspective view of the swimming fin of FIG. 1.

FIG. 2 is a perspective view showing the swimming fin having the second blade 12 disconnected from the first blade 11. Specifically, the stopper members 13 shown in FIG. 1 to be in connection to the second blade 12 may be detached therefrom and then the second blade 12 may be pulled toward the front end 19 of the first blade 11 to obtain a state as shown in FIG. 2. It should be understood that the stopper members 13 are eliminated in FIG. 2 to avoid a confused illustration.

Referring to FIGS. 1 and 2, the first blade 11 comprises a top surface 16 positioned on a foot instep side, a bottom surface 17 positioned on a foot sole inside, a rear end 18 being contiguous to the foot pocket 2 and a relatively easily deformable front end 19. First side rails 22 extend from respective outer sides of the foot pocket 2 to the front end 19 of the first blade 11 along transversely opposite side edges 21 which extend, in turn, between the front and rear ends 18, 19 of the first blade 11. These first side rails 22 project from both the top surface 16 and the bottom surface 17. Connecting holes 26 longitudinally extend through portions 24 of the first side rails 22 at which the rear ends 23 of the first side rails 22 are connected to the outer side of the foot pocket 2, respectively. Adjacent the foot pocket 2, the first blade 11 is formed at its transverse middle with an engaging hole 27 extending through the first blade 11 in the direction of its thickness. Adjacent the respective first side rails 22, the first blade 11 is formed in an intermediate region between the front and rear ends 19, 18 with third engaging-holes 28 extending through the first blade 11 in the direction of its thickness.

The second blade 12 has a top surface 31 facing the bottom surface 17 of the first blade 11 and a bottom surface 32 opposed to the top surface 31. Transversely, the second blade 12 comprises side edge regions 36 opposed to each other and an intermediate region 35 defined between these side edge regions 36. The side edge regions 36 longitudinally extend inside the respective side edges of the first blade 11 or inside the respective side rails 22 if such side rails 22 are provided. These side edge regions 36 terminate short of the front end of the first blade 11. The intermediate region 35 has a front end 34 defined by an edge extending between respective front ends of the side edge regions 36 and curved toward the rear end 18 of the first blade 11 and a rear end 33 defined by an edge curved substantially in conformity with an external shape of the foot pocket 2, i.e., curved in the direction opposed to the front end 34. Along the respective side edges 36, second side rails 37 project downward (i.e., upward as viewed in FIGS. 1 and 2) from the bottom surface 32 of the second blade 12 and longitudinally extend from the front end 34 to the rear end 33. Arms 38 extend rearward from rear ends of the respective second side rails 37 and connecting holes 39 transversely extend through these arms 38 in the proximity of their distal ends. In a transversely middle zone of the second blade 12, a pair of locking tongues 41 extend from the rear end 33 toward the foot pocket 2.

Figure 3:
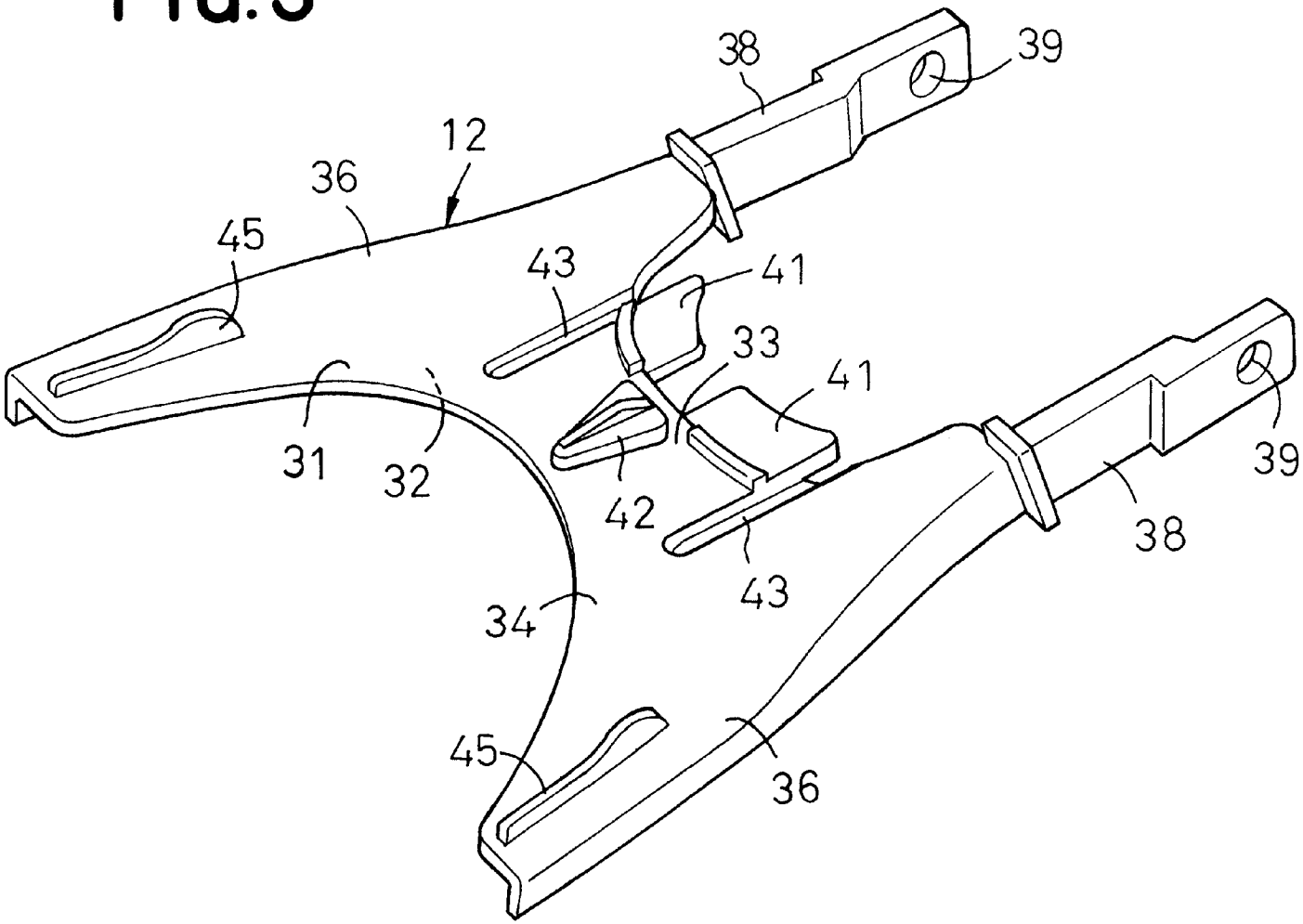
FIG. 3 is a perspective view showing a top surface of a second blade.

FIG. 3 is a perspective view showing the top surface 31 of the second blade 12. In a transverse middle of the rear end 33, the second blade 12 is formed on its top surface 31 with a first projection 42. On both sides of this first projection 42, the second blade 12 is formed with guide slits 43, respectively, each extending longitudinally of the second blade 12. Adjacent the front end 34 and the respective side edge regions 36, the second blade 12 is formed with relatively short second projections 45.

As will be apparent from FIG. 2, the front end of the foot pocket 2 adapted to be connected with the first blade 11 is formed with a pair of latch-lock recesses 46 each having a width slightly larger than the locking tongue 41 so as to receive the latter from the front. A pair of guide ribs 47 extend forward from respective outer side edges of this paired recess 46.

With the swimming fin constructed as has been described above, the rear ends of the respective arms 38 including the connecting holes 39 are exposed behind the respective connecting holes 26 lying on transversely opposite sides of the foot pocket 2 as the arms 38 of the second blade 12 are inserted from their positions in FIG. 2 into the respective connecting holes 26. In the course of such insertion, the first and second projections 42, 45 on the top surface of the second blade 12 are introduced into the second and engaging holes 27, 28 of the first blade 11, the engaging holes 27, 28 being slightly larger than the projections 42, 45, respectively, until the guide slits 43 are fully engaged with the guide ribs 47 and the locking tongues 41 are received by the latch-lock recesses 46. Then, the stopper means 13 are mounted on the respective rear ends of the arms 38 to prevent the second blade 12 from falling off. In this manner, the swimming fin as shown by FIG. 1 is obtained. In the course of insertion, the respective portions of the second blade 12 are engaged with the corresponding portions of the first blade 11 and thereby the second blade 12 can be positioned and temporarily fixed relatively to the first blade 11. Once the first and second blades 11, 12 have been assembled together, they can be reliably restrained from transversely shifting relatively to each other.

Figure 4:
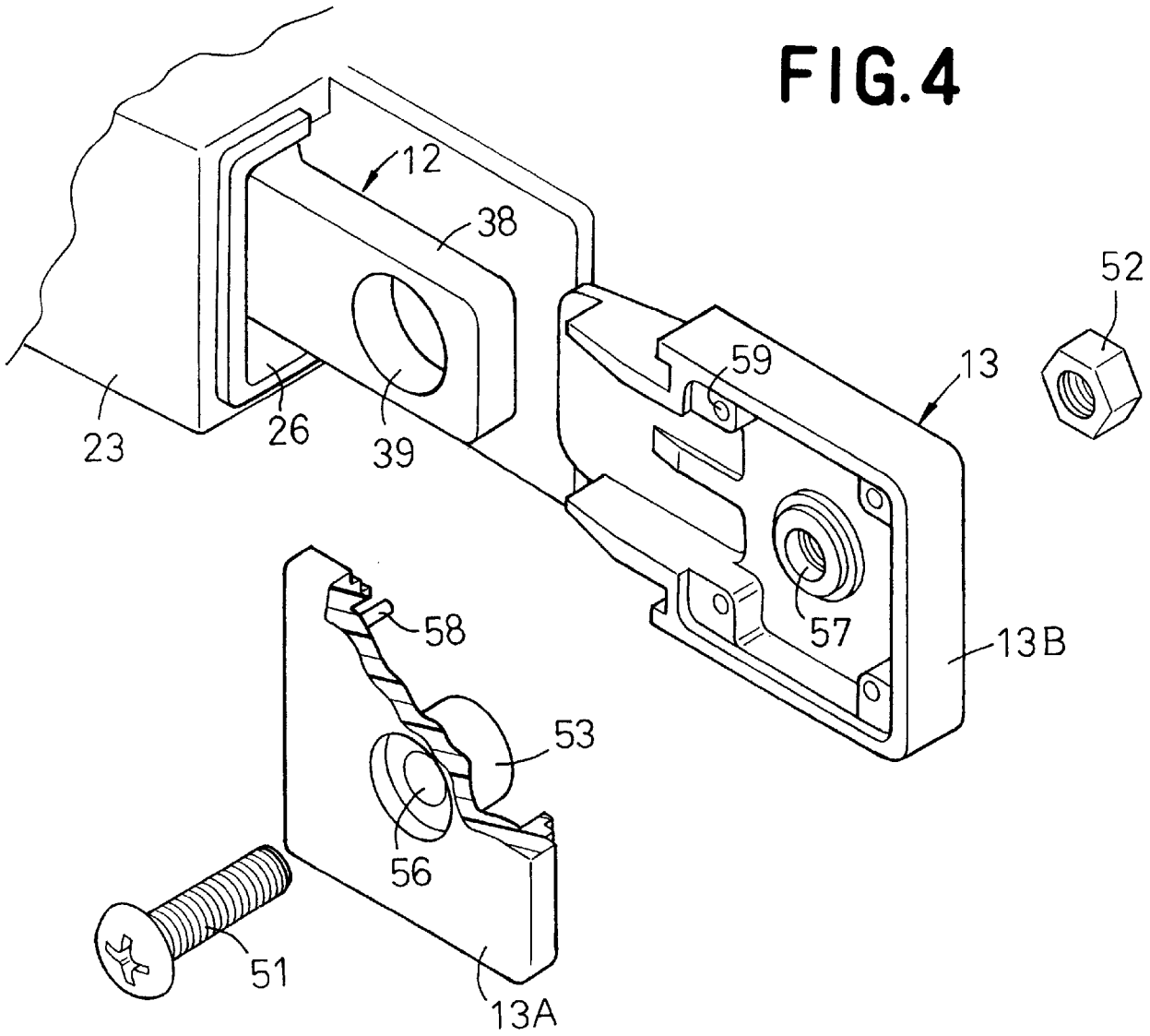
FIG. 4 is a fragmentary exploded perspective view of the swimming fin of FIG. 1.
Figure 5:
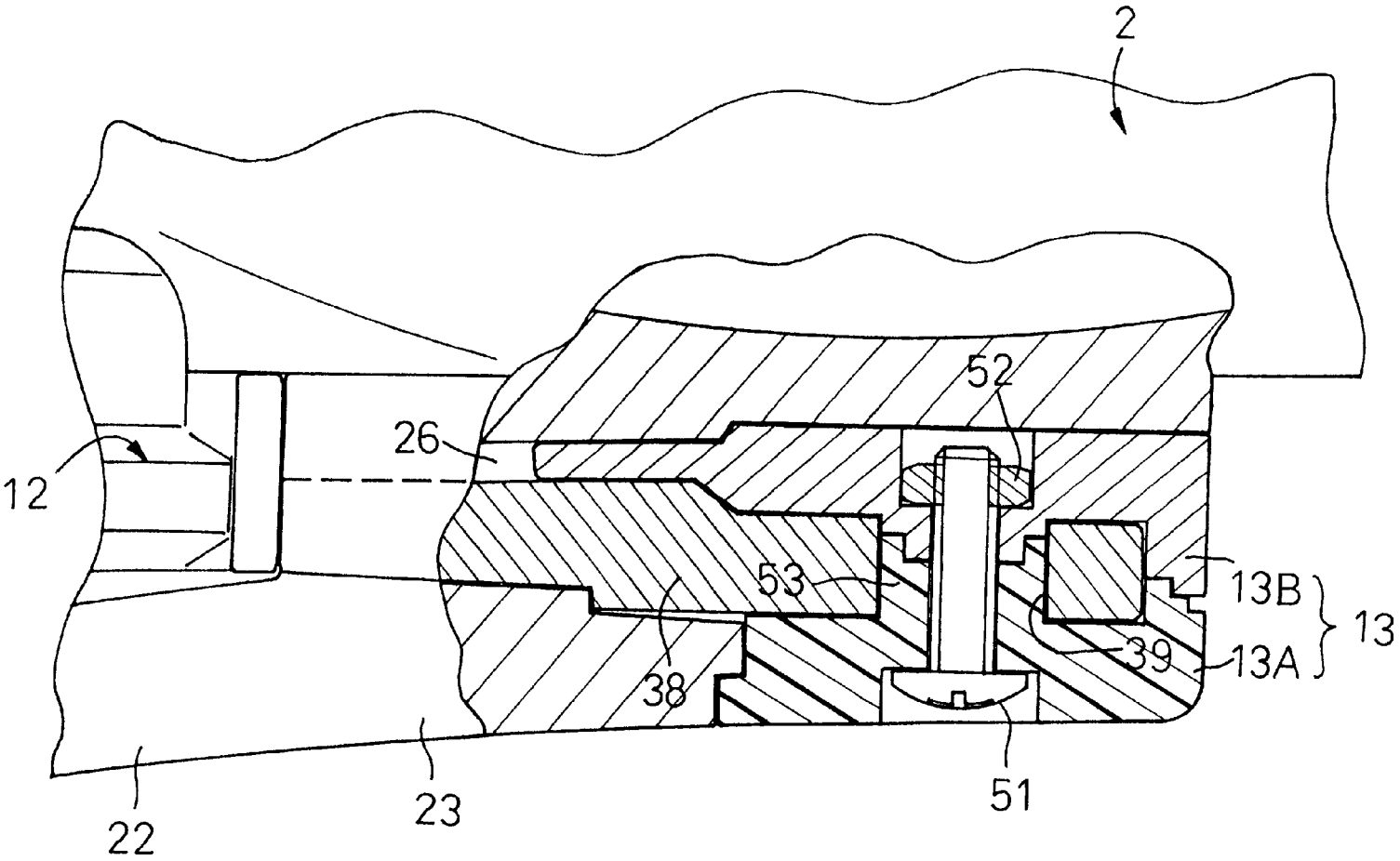
FIG. 5 is a sectional view taken along line V—V in FIG. 1.

FIG. 4 is a fragmentary exploded perspective view of the swimming fin, showing the stopper means 13, and FIG. 5 is a sectional view taken along line V—V in FIG. 1. The stopper means 13 comprise plate-like first and second members 13A, 13B, a bolt 51 and a nut 52. The first and second members 13A, 13B are adapted to be interlocked together with the rear end of the arm 38 interposed therebetween. Specifically, the first member 13A is placed against an outer lateral face of the arm 38 from the outside and then the second member 13B is inserted between the foot pocket 2 and the arm 38 so as to be placed against an inner lateral face of the arm 38. More specifically to describe, a cylindrical portion 53 of the first member 13A may be inserted into the connecting hole 39 of the arm 38, then respective connecting holes 56, 57 of the first and second members 13A, 13B may be aligned with each other to form an insertion hole for the bolt 51. The first and second members 13A, 13B are formed with a guide pin 58 and a guide hole 59, respectively, so that the connecting holes 56, 57 may be aligned with each other by engaging the guide pin 58 with the guide hole 59. The stopper means 13 comprising the first and second members 13A, 13B assembled together with interposition of the arm 38 may be dimensioned to be larger than the diameter of the first connecting hole 26 and thereby to prevent the arm 38 from falling off from the connecting hole 26.

With the swimming fin assembled in the manner as has been described above, the side edge regions 36 of the second blade 12 extend forward from the front end of the foot pocket 2 along inside the respective side rails 22 of the first blade 11. Such arrangement assures that the second blade 12 effectively limit an undesirable deformation, i.e., bending backward from the top surface 16 toward the bottom surface 17 of the first blade 11 which otherwise occurs under water pressure exerted on the top surface 16 of the swimming fin during down-kicking movement of the swimming fin. As a result, the first blade 11 is able to catch a relatively large amount of water underlying the top surface 16 and to move this amount of water vigorously from the rear end 18 toward the front end 19 of the first blade 11 to generate a high thrust. On the other hand, the portion of the first blade 11 extending forward from the curved front end 34 of the second blade 12 is substantially free from a restriction by the second blade 12 and transversely curved with the top surface 16 inside so as to form a channel along which the amount of water caught by the first blade 11 can be moved rearward. The first blade 11 transversely curved in this manner enables the thrust to be further strengthened since the amount of water caught by the first blade 11 is effectively prevented from escaping aside. During up-kicking movement of the swimming fin, the first blade 11 as a whole can be easily curved longitudinally with the top surface 16 inside around the front end of the foot pocket 2 without being restricted by the second blade 12. With the first blade 11 curved in this manner, no significant resistance is generated during the up-kicking movement and a physical burden imposed on a swimmer is alleviated, thus allowing a speedy movement of the swimmer.

The first blade 11 of the swimming fin operating as has been described above may be molded from suitably soft material such as rubber and plastic in a suitable thickness as well as a suitable cross-sectional shape in order that the first blade 11 can be easily curved with the minimum resistance generated during the up-kicking movement of the swimming fin. The second blade 12 is preferably molded from suitable material such as plastic and rubber in a suitable shape to give the second blade 2 sufficiently high rigidity to restrict a deformation of the first blade 11. For example, the side edges 36 of the second blade 12 preferably extend forward along the side edges 21 of the first blade 11 over a sufficient extend to restrict the undesirable deformation of the first blade during the down-kicking movement of the swimming fin, as will be apparent from FIGS. 1 and 2. The side edge regions 36 of the second blade 12 preferably have a length corresponding to 20% or more of the length along which the side edges 21 of the first blade 11 extend. In addition, the front end 34 of the second blade 12 is preferably curved in its transversely middle region as shown in order that the first blade 11 can be easily curved transversely during the down-kicking movement and easily curved longitudinally during the up-kicking movement of the swimming fin. The front end 34 may also have a curve describing a V-shape toward the foot pocket 2 to achieve the same effect as obtained by the illustrated embodiment. It is also possible to form ribs along the front edge 34, which project from the top surface 31 and/or the bottom surface 32, and thereby to improve rigidity of the second blade 12 transversely as well as longitudinally. An alternative configuration of the second blade 12 is also possible so that only the side edge regions 36 of the second blade 12 restrict the undesirable deformation of the first blade 11. It is also possible to mold the second blade 12 integrally with the foot pocket 2 and/or the first blade 11. In this case, these first and second blades 11, 12 should be spaced from each other in the direction of thickness except their rear ends 18, 33 to prevent the second blade 12 from obstructing a desired deformation of the first blade 11 during the up-kicking movement of the swimming fin. The first blade 11 may have the first side rails 22 on any one of the top and bottom surfaces 16, 17 or may have none of such first side rails 22. The second blade 12 may have the second side rails 37 on the top surface 31 also or may have none of such second side rails 37.

What is claimed is:

1. A swimming fin comprising:

a foot pocket having a front end;

a blade extending forward from the front end of said foot pocket; and said blade including a first blade member and a second blade member shorter than said first blade member and underlying said first blade member, said second blade member including transversely opposite side edge regions which extend from the front end of said foot pocket forward inside transversely opposite side edges of said first blade member and terminate short of a front end of said first blade member, and an intermediate region which extends between said side edge regions and which has a front end substantially curved toward said foot pocket, said first and second blade members having rear portions that are held adjacent to one another and forward portions that are separable from one another, so that the second blade member supports the first blade member during a down-kicking movement and does not restrict the first blade member from curving along a longitudinal length during an up-kicking movement.

2. A swimming fin according to claim 1, wherein said foot pocket and said first blade are integral moldings and said second blade is detachably assembled with said moldings.

3. A swimming fin according to claim 1, wherein said second blade member is provided along said side edge regions with arms extending rearward, said arms being removably inserted into longitudinal locking holes formed on transversely opposite outer sides of said foot pocket.

4. A swimming fin according to claim 1, wherein said second blade member, said foot pocket and said first blade member are integral.

5. A swimming fin according to claim 1, wherein said second blade member and said foot pocket are integral.

6. A swimming fin according to claim 1, wherein said second blade member and said first blade member are integral.

7. A swimming fin comprising:

a foot pocket having a front end;

a blade extending forward from the front end of said foot pocket; and said blade including a first blade member and a second blade member shorter than said first blade member and underlying said first blade member, said second blade member including transversely opposite side edge regions which extend from the front end of said foot pocket forward inside transversely opposite side edges of said first blade member and terminate short of a front end of said first blade member, and an intermediate region which extends between said side edge regions and which has a front end substantially curved toward said foot pocket, said foot pocket and said first blade being integral moldings and said second blade being detachably assembled with said moldings.

8. A swimming fin comprising:

a foot pocket having a front end;

a blade extending forward from the front end of said foot pocket; and said blade including a first blade member and a second blade member shorter than said first blade member and underlying said first blade member, said second blade member including transversely opposite side edge regions which extend from the front end of said foot pocket forward inside transversely opposite side edges of said first blade member and terminate short of a front end of said first blade member, and an intermediate region which extends between said side edge regions and which has a front end substantially curved toward said foot pocket, said second blade being provided along said side edge regions with arms that extend rearward and are removably inserted into longitudinal locking holes formed on transversely opposite outer sides of said foot pocket.

* * * * *